US005592151A

United States Patent [19]

Rolih

[11] Patent Number: 5,592,151

[45] Date of Patent: Jan. 7, 1997

[54] FIRE MONITORING SYSTEM

[75] Inventor: Vladimir Rolih, Winterthur, Switzerland

[73] Assignee: Von Roll Umwelttechnik AG, Zurich, Switzerland

[21] Appl. No.: 406,074

[22] Filed: Mar. 17, 1995

[30] Foreign Application Priority Data

Mar. 17, 1994 [CH] Switzerland ..... 797/94

[51] Int. Cl.[6] ..... G08B 17/00

[52] U.S. Cl. ..... 340/584; 340/653; 250/342; 348/373; 348/164; 348/159; 396/428; 396/535

[58] Field of Search ..... 340/584, 587, 340/588, 589, 577, 578, 651, 525, 658; 358/113, 108, 104, 241; 250/342, 347, 338.1, 338.24; 354/288; 348/373, 164

[56] References Cited

U.S. PATENT DOCUMENTS

| | | | |
|---|---|---|---|
| 3,969,714 | 7/1976 | Greer | 340/685 |
| 4,131,914 | 12/1978 | Bricmont | 348/373 |
| 4,414,576 | 11/1983 | Randmae | 348/373 |
| 4,524,386 | 6/1985 | Scott | 358/113 |
| 4,730,113 | 3/1988 | Edwards et al. | 250/347 |
| 4,815,008 | 3/1989 | Kadonoff et al. | 364/559 |
| 5,045,699 | 9/1991 | Schulze et al. | 250/347 |
| 5,045,937 | 9/1991 | Myrick | 348/164 |
| 5,059,953 | 10/1991 | Parsons et al. | 340/578 |
| 5,153,722 | 10/1992 | Goedeke et al. | 358/108 |
| 5,237,308 | 8/1993 | Nakamura | 340/588 |
| 5,289,275 | 2/1994 | Ishii et al. | 340/578 |
| 5,394,208 | 2/1995 | Campbell | 354/288 |

FOREIGN PATENT DOCUMENTS

| | | |
|---|---|---|
| 0311148 | 4/1989 | European Pat. Off. . |
| 0421032 | 4/1991 | European Pat. Off. . |
| 3826379 | 10/1989 | Germany . |
| 3819411 | 12/1989 | Germany . |
| WO91/09389 | 6/1991 | WIPO . |
| WO91/17394 | 11/1991 | WIPO . |

OTHER PUBLICATIONS

Onzieme Colloque Sur Le Traitement Du Signal Et Des Images, pp. 587–590, Jun. 1987, G. Jacovitti, et al., "A real Time Image Processor For Automatic Bright Spot Detetion".

*Primary Examiner*—Jeffery Hofsass
*Assistant Examiner*—Benjamin C. Lee
*Attorney, Agent, or Firm*—Oblon, Spivak, McClelland, Maier & Neustadt, P.C.

[57] ABSTRACT

A fire monitoring system for waste bunkers includes a pair of infrared cameras, which are arranged on an axis of rotation. The axis of rotation is connected to a controllable drive motor and to an angle transmitter. Furthermore, the fire monitoring system has a computer for digitizing the thermal images determined by the pair of infrared cameras and for calculating the spatial coordinates of hot places inside the waste bunker. The calculation of these hot places is carried out based on the thermal images determined by the pair of infrared cameras and digitized, and the data supplied by the angle transmitter.

18 Claims, 3 Drawing Sheets

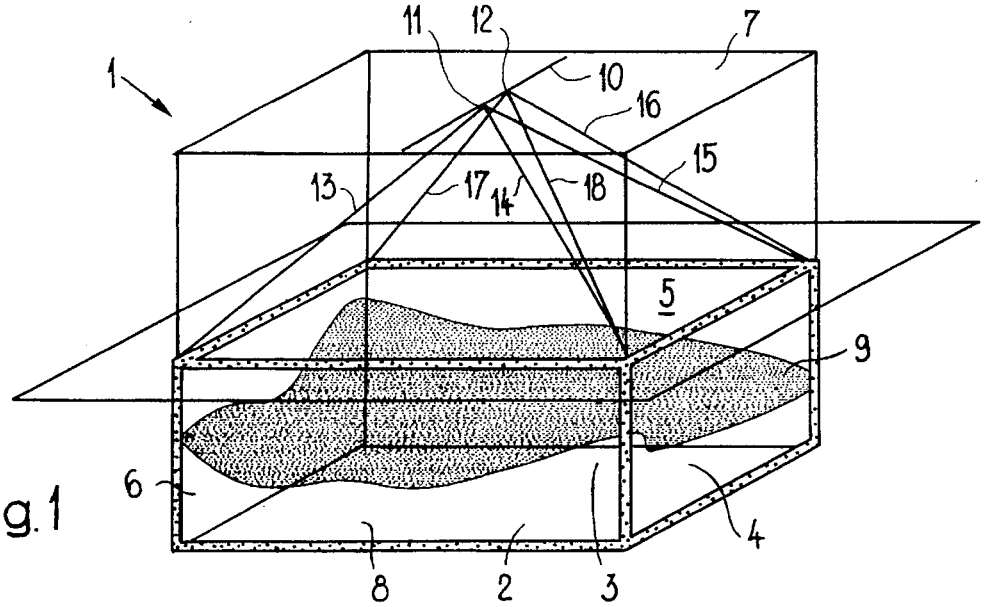
Fig.1
Fig.4
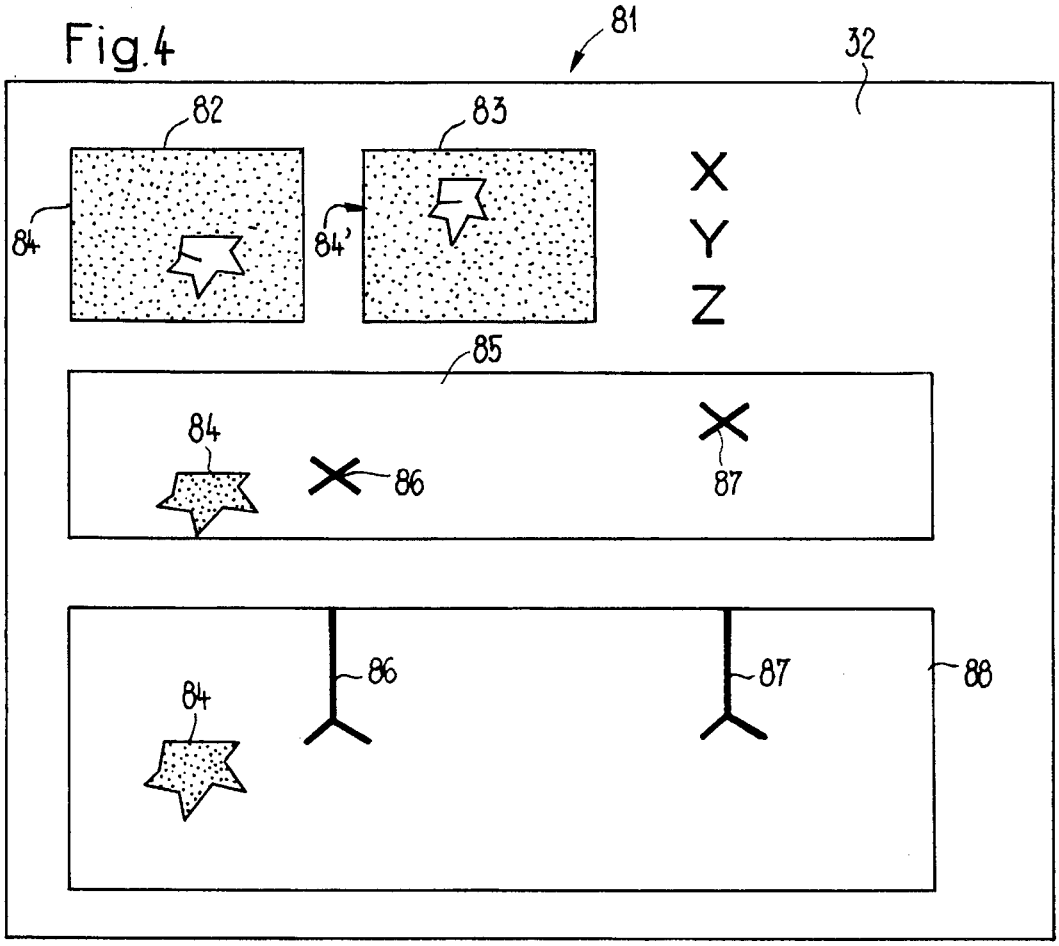

FIRE MONITORING SYSTEM

BACKGROUND OF THE INVENTION

1. Field of the Invention

The invention relates to a fire monitoring system for waste bunkers including an infrared camera for the fire monitoring system and a method for fire monitoring.

2. Discussion of the Background

Waste which is intended to be incinerated is stored upstream of a waste incineration plant in a closed space, in a so-called waste bunker. The waste, stored in the form of loose material, can catch fire for various reasons. In a so-called bunker fire, environmentally damaging gases are produced, which represent an exceptional environmental loading in the vicinity of the waste incineration plant. Furthermore, a bunker fire leads to an interruption of operations with corresponding technical, logistical and economic problems. Since bunker fires are occurring ever more often, there is a requirement to combat them effectively.

The effective combating of bunker fires presupposes the early detection and location of warm places, that is to say sources of fire, in the bunker. Such an early detection and location is problematical for various reasons. The visibility in the air space of the bunker is insufficient, since the air is laden with dust and an intense development of smoke precedes the fire. The surface of the mass of waste is not even and distortions of an optical image of this surface result from the higher and lower places and from changes resulting from waste removal, delivery and restocking.

Until now, fire detection was carried out in practice visually by a crane driver who operates a crane for loading and unloading the bunker. This type of fire monitoring is unsatisfactory. Various attempts for improving the current state have therefore been undertaken.

In "From the activities of the LIS 1989" (Essen 1990), under the title: "Possibilities for the early detection of waste bunker fires—Results of trials with thermography systems", U. Euteneuer reports on the use of a thermal imaging camera, with which, however, only a thermal diagram, that is to say a linear temperature image of a very narrow surface fire, could be recorded. However, since in the early detection of bunker fires the exact localization of the source of fire forms one of the essential problems, no suitable solution to the problem could be proposed on the basis of these trials.

SUMMARY OF THE INVENTION

Accordingly, one object of the present invention is to provide a novel fire monitoring system for the early detection of fires in waste bunkers, and in particular for precise localization of sources of the fires.

The system according to the present invention achieves this objective by the automatic exact spatial detection of places having an increased temperature, that is to say of possible sources of fire, in the waste bunker, before the actual outbreak of fire, and hence timely and specific fire-fighting is made possible. The applicants of the present invention have determined that only the determination of the exact spatial, that is to say three-dimensional, coordinates of the locations having increased temperature enables the successful fire-fighting in the waste bunker.

Digitizing two thermal images, which are made, by two infrared cameras arranged at a distance from each other, of the same region of the waste bunker, together with a determination of the exact angle value by means of an angle transmitter enables the determination of the spatial coordinates of the places having increased temperatures and, thereby, locations for specific fire-fighting efforts can be determined. Since only the location of an event, that is to say a temperature increase, is to be detected, no highly sensitive infrared camera is needed according to the invention, rather a so-called fire-fighting camera, which signals the warm places as a light spot, is sufficient.

In order to improve the reliability of the system, a test element having a surface which can be heated in a controlled manner can be arranged inside the waste bunker. By means of periodic heating of the surface of this test element, the functional capability of the system according to the invention can be checked.

For calibrating the system according to the invention, that is to say for determining the spatial coordinates in the waste bunker, heatable calibration elements are provided. These heatable calibration elements are fitted inside the waste bunker at predetermined places, are heated and, by determining their spatial coordinates—which are known per se—the system is calibrated, or the calibration is checked, as required.

Preferably, a screen is provided, connected to the system, for the optical display of the digitized thermal images. By this means, without a visual connection to the interior of the waste bunker, optical information is supplied to the operating personnel, which makes the rectification of a heating of a source of fire simpler and accelerates the fire-fighting process.

Advantageously, the system has an alarm device which triggers an optical and/or acoustic alarm in the case of a predetermined threshold temperature being exceeded at one or more places in the waste bunker. The alarm device can, if desired, have means for the automatic triggering of steps for the rectification of the sources of the hot places.

The system of the present invention preferably has a storage means, which stores data of the alarm processes, such as spatial coordinates of the source of fire, from the instant of the detection and the time interval up to the time of triggering the alarm and up to engaging the necessary steps for the rectification of the sources of the heating.

The spatial coordinates of the hot places determined by the fire monitoring system according to the invention can be communicated to a further system for initiating predetermined steps, for example triggering a specific automatic extinguishing process.

By means which determine the position of grabs of the cranes arranged in the bunker and feed them into the system for supplementing the other data, the steps necessary for rectifying the heating/source of a fire can be undertaken quickly and efficiently, in that extinguishing means can be taken by the grabs to the heated place or the waste at this place can be lifted out.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a perspective representation of a waste bunker;

FIG. 4 shows a screen representation of a thermal image.

DESCRIPTION OF THE PREFERRED EMBODIMENTS

Figure 2:
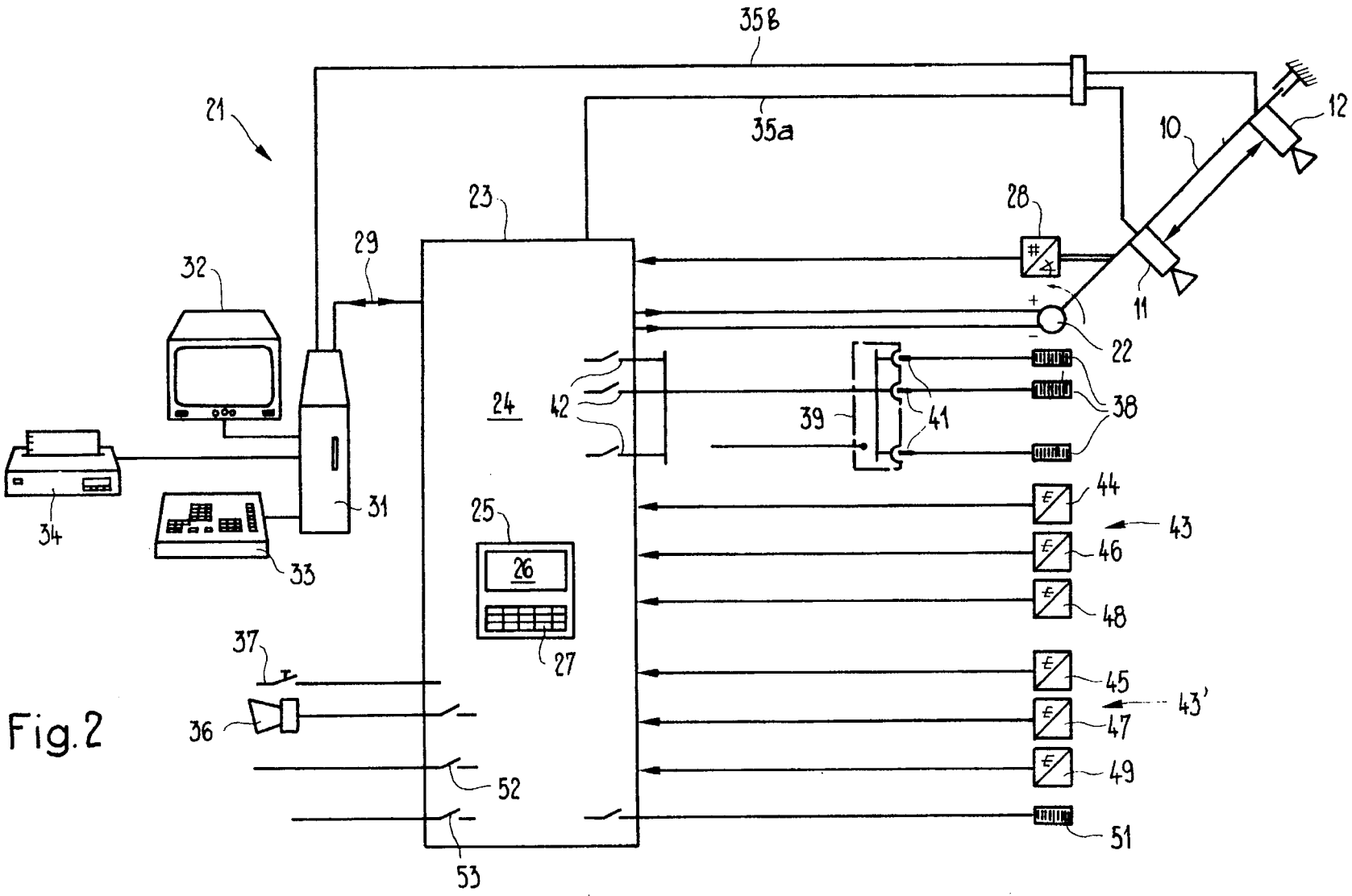
FIG. 2 shows a schematic picture of a system according to the invention.

Referring now to the drawings, wherein like reference numerals design identical or corresponding parts throughout the several views, and more particularly to FIG. 1 thereof, a waste bunker 1 is shown schematically and has a bottom 2, four side walls 3, 4, 5, 6 and a cover 7. The whole bottom 2 is covered by waste 8.

The surface 9 of the waste 8 is three-dimensional, that is to say the waste 8 has a hills-and-valleys topography. Underneath the cover 7, two infrared cameras 11, 12 are arranged on one axis of rotation 10 at a distance from one another and are directed in parallel. The cameras 11, 12—as illustrated by the lines 13 to 18—sweep over the entire surface 9 of the waste 8 at a predetermined cyclic frequency, by actuating the axis of rotation 10. In large waste bunkers, the arrangement of a plurality of pairs of infrared cameras may be necessary.

One implementation of the system of the present invention as shown in FIG. 1 is shown in FIG. 2. The system 21 in FIG. 2 includes two infrared cameras 11, 12 arranged on the axis of rotation 10, and the axis of rotation 10 is connected to a drive motor 22. The drive motor 22, as indicated by an arrow, can be rotated in two directions and is connected to a control device 23. The control device 23 has analog and digital inputs and outputs, a memory-programmable controller 24, and an operating station 25 with an input element 27 and a display 26. The axis of rotation 10 has allocated to it an angle transmitter 28, which is connected to the control device 23. Preferably, angle transmitter 28 is an absolute angle transmitter with a digital output and a minimum resolution of 12 bits or more.

The control device 23 is connected to a computer 31 via a serial interface 29. A screen 32, an operating keyboard 33 and a report printer 34 are allocated to the computer 31.

The drive motor 22 is driven by the computer 31 via the control device 23. The rotational position of the axis of rotation 10 is sampled by the angle transmitter 28 and its signals, for example from a 12-bit parallel bus, are fed to the control device 23.

Both infrared cameras 11, 12 are fed from the control device 23 via a feed line 35*a*. The video signals of the infrared camera 11, 12 are fed to the computer 31 via a video line 35*b*. In computer 31 the video signals are digitized and the data is shown on the screen 27 or printed out by the report printer 28.

According to the system of the present invention, the output of the infrared cameras 11 and 12 and a determination of their angle of orientation by angle transmitter 28 are utilized to determine the exact spatial coordinates and thus location of any hot spots within the bunker 1.

If, on the basis of the thermal image data detected by the infrared cameras 11, 12, a light/dark differentiation of heated/non-heated is sufficient, an undesired heating is determined, and a warning device 36 is activated via the control device 23. The warning device 36 can be arranged, for example, in the cabin of cranes 43, 43' which load the waste bunker 1. By means of an operating element 37 arranged at the same location and likewise connected to the control device 23, the warning can be acknowledged by the crane driver. The duration of the sampling of a bunker is determined in accordance with the circumstances of the individual case.

For calibrating the spatial coordinates of the waste bunker 1, sixteen calibration elements 38 having a heatable surface are arranged in the waste bunker 1, at least at the start of the operation of the system 21. These individual calibration elements 38 are connected to corresponding outputs 42 of the control device 23 via a field connection box 39 having sockets 41 and can be driven individually.

Allocated to the grab of the two cranes 43, 43' arranged in the waste bunker is a longitudinal transmitter 44, 45, a transverse transmitter 46, 47 and a depth transmitter 48, 49. These transmitters establish the position of the grabs and communicate the data to the control device 23.

Finally, there is arranged in the waste bunker 1 a test element 51 which can be heated under control of the control device 23, with which the functional capability of the system 21 can be checked periodically, in that a test alarm is triggered by heating up the test element 51. These test alarms are also recorded and printed out in the report.

Apart from the outputs mentioned, the control device 23 has an output 52 for a further alarm report and an output 53 for a system disturbance report.

If a report of an event is present, that is to say if a place having an increased temperature is determined, an extinguishing process can be initiated in various ways after triggering the alarm. For example, an extinguishing and cooling action can be carried out automatically with a locally specific extinguishing intervention such as sprinklers, or one of the crane grabs can be driven manually or automatically into position and then positions extinguishing means at the hot place or lifts out the hot material.

Figure 3:
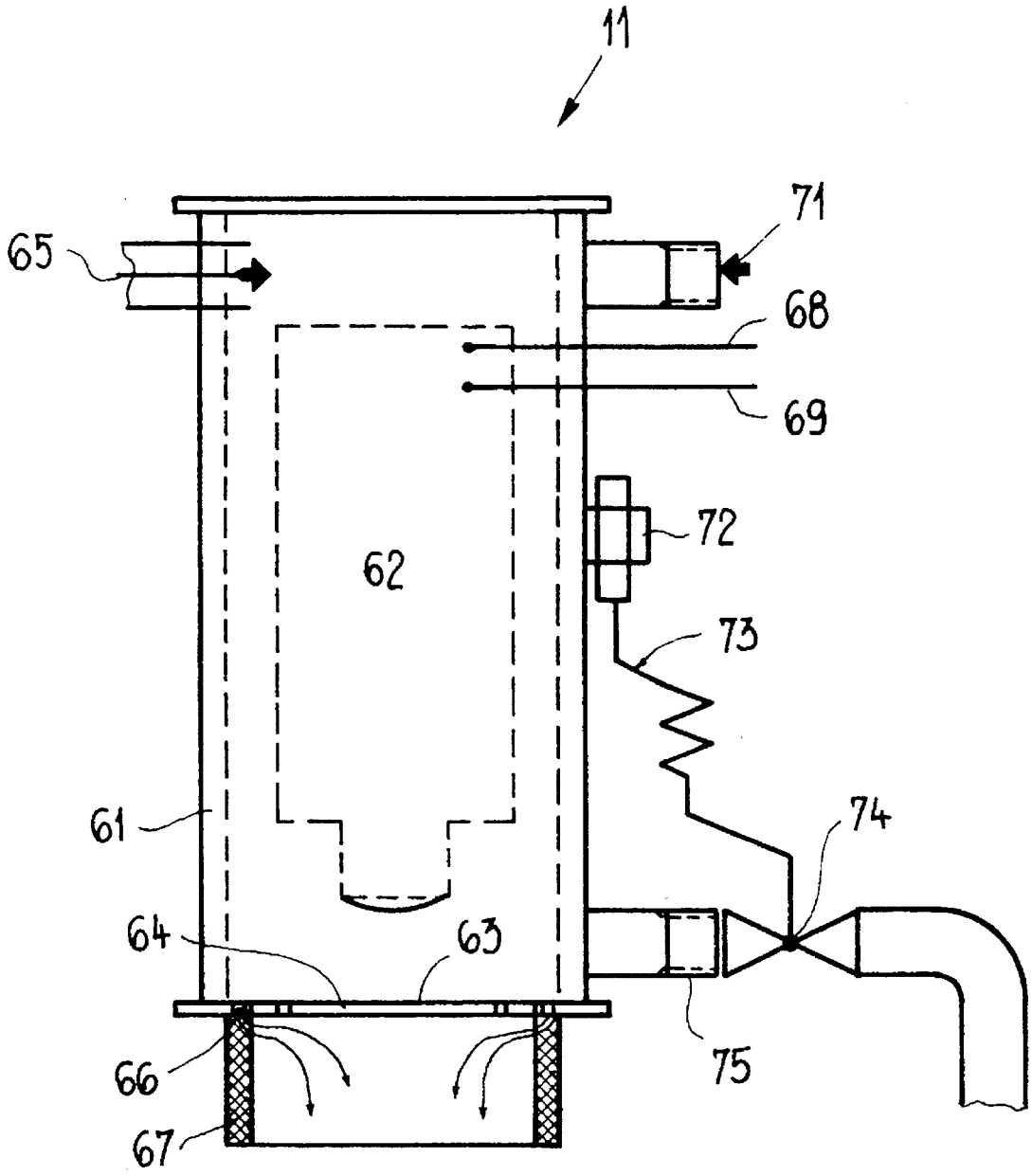
FIG. 3 shows a section through an infrared camera according to the invention.

The infrared camera 11 is shown in detail in FIG. 3 and has a double-walled camera housing 61, in which the actual thermal imaging camera 62 is arranged. The thermal imaging camera 62 preferably has a sensitivity range from 8 μm to 12 μm and preferably indicates temperature differences of about 2° C. or more. The bottom 63 of the infrared camera 11 is partially formed by an IR-transparent glass window 64, made for example out of germanium glass. In the upper part of the camera housing 61 an inlet 65 for flushing air is arranged and, on the bottom 63, outlet openings 66 for the flushing air are arranged. A tube 67 made of porous sintered material is connected to the openings 66, through which tube (as indicated by arrows) the flushing air leaves the infrared camera 11 and thus prevents the steaming up of the glass window 64.

The thermal imaging camera 62 has connections 68, 69 both for the supply and also for communicating the thermal images. Furthermore, in the upper part of the camera housing 61, there is a water inlet 71 for cooling water. The water cooling is activated—only on reaching a predetermined temperature in the range of, for example, 50° to 90° C.—by a temperature sensor 72 arranged externally on the camera housing 61, in that the temperature sensor actuates a valve 74 in a water outlet 75 arranged on the lower part of the camera housing 61, via a capillary tube 73. The water cooling the infrared camera is connected to a pressurized water line, for example to a public supply or that of a sprinkler system. For the system according to the invention, a simple thermal imaging camera without dedicated cooling, which does not deliver a true thermal image but only thermal points, can also be used.

In FIG. 4, an event image 81 on the screen 32 allocated to the computer 31 is shown. The upper part of the event image shows two camera images 82, 83, on which a place having an increased temperature, a potential source of fire in the waste bunker, appears as a bright spot 84, 84'. On a second, central image 85, the position 86, 87 of the grabs of the two cranes and of the source of fire 84 is shown in plan view and, in a third lower image 88, a side view is shown. In the upper right-hand corner of the screen, the coordinates of the source of the fire are specified with X, Y, Z.

The screen representation facilitates the work of the operating personnel and accelerates intervention where applicable.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fire monitoring system for a waste bunker, comprising:

a pair of infrared detector means arranged at a distance from each other and both being arranged on a same axis of rotation for detecting spots in the bunker which exceed a predetermined temperature;

a controllable drive means connected to the axis of rotation;

an angle transmitter means connected to the axis of rotation for transmitting data of angles of orientation of the pair of infrared cameras;

a processing means for digitizing the thermal images determined by the pair of infrared detector means and for calculating spatial coordinates of the spots in the waste bunker which exceed the predetermined temperature based on the digitized thermal images determined by the pair of infrared detector means and the data supplied by the angle transmitter means.

2. The system according to claim 1, further comprising a test means arranged inside the waste bunker and having a surface which can be heated in a controlled manner for a periodical functional testing of the system.

3. The system according to claim 1, further comprising a plurality of heatable calibration means formed inside the waste bunker and arranged above a waste layer at predetermined distances from each other, for calibrating spatial coordinates of the waste bunker.

4. The system according to claim 1, further comprising a display means for displaying the thermal images determined by the pair of infrared detector cameras.

5. The system according to claim 1, further comprising an alarm means for triggering an alarm in a case of the temperature being exceeded at one or more places inside the waste bunker.

6. The system according to claim 1, further comprising a storage means for storing data in connection with an alarm.

7. The system according to claim 1, wherein cranes, each crane including grab and transmitter means, are used in the waste bunker, and wherein the computer detects a position of the grabs of the cranes used in the waste bunker based on data from the transmitter means.

8. An infrared camera for the fire monitoring system according to claim 1, wherein each thermal imaging detecting means is arranged in a double-walled housing including inlet and outlet openings, arranged on the housing, for flushing an inside of the housing with clean air.

9. The infrared camera according to claim 8, wherein the housing further comprises an inlet and outlet for cooling water, the outlet for cooling water being provided with a temperature-controlled valve which is transferred from a closed to an open position in an event of a predetermined temperature increase.

10. A fire monitoring system for a waste bunker, comprising:

a pair of infrared cameras arranged at a distance from each other and both being arranged on a same axis of rotation and to be directed to a same area of the waste bunker for detecting spots in the bunker which exceed a predetermined temperature;

a controllable drive motor connected to the axis of rotation;

an angle transmitter connected to the axis of rotation for transmitting data of angles of orientation of the pair of infrared cameras;

a computer for digitizing the thermal images determined by the pair of infrared cameras and for calculating spatial coordinates of the spots in the waste bunker which exceed the predetermined temperature based on the digitized thermal images determined by the pair of infrared cameras and the data supplied by the angle transmitter.

11. The system according to claim 10, further comprising a test element arranged inside the waste bunker and having a surface which can be heated in a controlled manner for a periodical functional testing of the system.

12. The system according to claim 10, further comprising a plurality of heatable calibration elements formed inside the waste bunker and arranged above a waste layer at predetermined distances from each other, for calibrating spatial coordinates of the waste bunker.

13. The system according to claim 10, further comprising a display for displaying the thermal images determined by the pair of infrared cameras.

14. The system according to claim 10, further comprising an alarm which is triggered in a case of the predetermined temperature being exceeded at one or more places inside the waste bunker.

15. The system according to claim 10, further comprising a storage device for storing data in connection with an alarm.

16. The system according to claim 10, wherein cranes, each crane including a grab and transmitter means, are used in the waste bunker, and wherein the computer detects a position of the grabs of the cranes used in the waste bunker based on data from the transmitter means.

17. An infrared camera for the fire monitoring system according to claim 10, wherein each thermal imaging camera is arranged in a double-walled housing including inlet and outlet openings, arranged on the housing, for flushing an inside of the housing with clean air.

18. The infrared camera according to claim 17, wherein the housing further comprises an inlet and outlet for cooling water, the outlet for cooling water being provided with a temperature-controlled valve which is transferred from a closed to an open position in an event of a predetermined temperature increase.

* * * * *

UNITED STATES PATENT AND TRADEMARK OFFICE

CERTIFICATE OF CORRECTION

PATENT NO. : 5,592,151

DATED : January 7, 1997

INVENTOR(S) : Vladimir ROLIH

It is certified that error appears in the above-indentified patent and that said Letters Patent is hereby corrected as shown below:

On the title page, Item [30], the Foreign Application Priority Data should read:

--Mar. 17, 1994 [CH] Switzerland.....797/94-5--

Signed and Sealed this

Thirteenth Day of May, 1997

Bruce Lehman

*Attest:*

BRUCE LEHMAN

*Attesting Officer*

*Commissioner of Patents and Trademarks*